US009376839B2

(12) United States Patent
Chen

(10) Patent No.: US 9,376,839 B2
(45) Date of Patent: Jun. 28, 2016

(54) ELECTRONIC LOCK CYLINDER, ELECTRONIC LOCK SYSTEM CONTAINING SAME AND METHOD FOR UNLOCKING LOCK

(71) Applicant: GUANGZHOU AVARTA ELECTRONICS TECHNOLOGY CO., LTD., Guangdong (CN)

(72) Inventor: Binghui Chen, Guangong (CN)

(73) Assignee: GUANGZHOU AVARTA ELECTRONICS TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 14/410,522

(22) PCT Filed: Jul. 3, 2013

(86) PCT No.: PCT/CN2013/000814

§ 371 (c)(1),
(2) Date: Dec. 22, 2014

(87) PCT Pub. No.: WO2014/005422

PCT Pub. Date: Jan. 9, 2014

(65) Prior Publication Data

US 2015/0184423 A1 Jul. 2, 2015

(30) Foreign Application Priority Data

Jul. 3, 2012 (CN) ..... 2012 1 0228780

(51) Int. Cl.
*E05B 47/00* (2006.01)
*E05B 47/06* (2006.01)
*E05B 67/24* (2006.01)

(52) U.S. Cl.
CPC ..... *E05B 47/0001* (2013.01); *E05B 47/0004* (2013.01); *E05B 47/0611* (2013.01); *E05B 67/24* (2013.01); *Y10T 70/7486* (2015.04)

(58) Field of Classification Search
CPC ..... E05B 67/22; E05B 2047/0024; E05B 2047/0058; E05B 47/06; E05B 67/24; E05B 47/00; E05B 47/0002; E05B 47/0004; E05B 47/0603; E05B 47/063; E05B 47/0673; E05B 47/02; E05B 47/0611; E05B 47/0642; Y10T 70/7079; Y10T 70/7904; G07C 1/32; G07C 2009/00761; G07C 9/00; G07C 2009/00753; G07C 9/00658; G07C 2209/08; G07C 9/00031; G07C 9/00174
USPC ..... 70/278.3
See application file for complete search history.

(56) References Cited

U.S. PATENT DOCUMENTS 6,155,089 A * 12/2000 Hurskainen ..... E05B 47/0623 70/187
2004/0055346 A1 3/2004 Gillert

FOREIGN PATENT DOCUMENTS

CN 101418656 4/2009
CN 201610663 10/2010

(Continued)

OTHER PUBLICATIONS

International Preliminary Report on Patentability for Application No. PCT/CN2013/000814 dated Jan. 6, 2015, with Written Opinion of the International Searching Authority dated Oct. 17, 2013.

(Continued)

*Primary Examiner* — Suzanne Barrett
(74) *Attorney, Agent, or Firm* — Jenkins, Wilson, Taylor & Hunt, P.A.

(57) ABSTRACT

An electronic lock cylinder, includes a mechanical rotation core, electronic rotation core, barrel-shaped housing with both ends opened for accommodating the rotation cores, and a retainer rod, the rotation cores fixed axially to each other via an electromagnet core, and the mechanical rotation core and the housing fixed to each other via the retainer rod. When the core is retracted, the rotation cores can rotate through a certain angle with respect to each other, and the retainer rod is moved such that the rotation cores are fixed to each other and rotate together, now rotating the electronic rotation core by using an electronic key, and a deflector rod of the mechanical rotation core is driven to rotate such that the lock is unlocked. Further disclosed are an electronic lock system including the electronic lock cylinder and a method for unlocking a lock. Axial fixation between the rotation cores is achieved.

10 Claims, 13 Drawing Sheets

(56) References Cited

FOREIGN PATENT DOCUMENTS

| | | |
|---|---|---|
| CN | 201991331 | 9/2011 |
| CN | 202788266 | 3/2013 |
| EP | 1378620 | 1/2004 |
| JP | 1-250574 | 10/1989 |

OTHER PUBLICATIONS

International Search Report for Application No. PCT/CN2013/000814 dated Oct. 17, 2013.

* cited by examiner

ELECTRONIC LOCK CYLINDER, ELECTRONIC LOCK SYSTEM CONTAINING SAME AND METHOD FOR UNLOCKING LOCK

TECHNICAL FIELD

The present invention relates to an electronic lock cylinder, an electronic lock system containing the same and a method for unlocking a lock.

BACKGROUND OF RELATED ART

Currently the electronic locks in market are mainly classified into two categories: for an electronic lock of one category, the lock body itself is provided with a power source used to supply electricity, and a lock of this category has two major disadvantages: (1) since the lock has a battery therein, it is necessary to replace the battery periodically, leading to high maintenance cost; (2) because the battery is disposed in the lock body, the volume of the lock is relatively large, making it impossible for the lock to be applied to products such as a padlock, a suitcase lock, and so on. For an electronic lock of the other category, there is no power source in the lock body, and the power source required to unlock the lock is supplied by a key, thus, the volume of the lock cylinder of the lock belonging to this category is reduced compared with that of the electronic lock described in the first category. Defects remain yet exist in the following aspects for the electronic lock cylinder of this category:

(1) Rotation of the electronic lock cylinder is driven by a motor, and the volume of the motor is relatively large, therefore, the volume of the electronic lock cylinder cannot be further reduced, moreover, the motor has the disadvantage of a slow response speed.

(2) Driving devices (such as a motor) for the electronic lock cylinder usually adopt a method of using a key to supply electricity to the lock cylinder and provide the stored authority data, and cutting off the electricity after continuingly supplying electricity for 5 to 10 seconds. Such method always wastes lots of electric energy, and the battery disposed in the key needs to be replaced frequently, which greatly decreases the unlocking number of times with the key.

(3) Unlocking record made by the key or the electronic lock cylinder is not accurate enough, since each time the key is inserted into the electronic lock cylinder, it will be recorded as unlocking once after the contacts of the key contact with the electronic contacts of the electronic lock cylinder, without considering whether the lock is unlocked or not, therefore, resulting in that the unlocking activities cannot be recorded correctly.

SUMMARY

Aiming at the defects described above in the prior art, one technical problem to be solved by the present invention is to provide an electronic lock cylinder that is of high integration, fine anti-prizing and a simple structure.

To solve the problems described above, the present invention adopts the following technical aspects:

an electronic lock cylinder, comprising a mechanical rotation core, an electronic rotation core, a barrel-shaped housing with both ends opened for accommodating the mechanical rotation core and the electronic rotation core, and a retainer rod; wherein, one end of the housing is a front end, and a position limitation chuck for axial position limitation is provided at the opening of the front end; one end of the mechanical rotation core is a flat deflector rod, wherein the deflector rod is projected out of the front end of the housing, and a rear end of the mechanical rotation core is a first cylindrical cavity, wherein at a position outside of the circle center of a bottom portion of the first cavity, there is a concave or recessed portion; a segment of the wall of the first cavity protrudes in its axial direction, forming a cambered position limitation portion, wherein a mechanical rotation core retainer slot, which is a through slot and in parallel with the axis of the first cavity, is provided at the middle portion of the cambered position limitation portion, dividing the cambered position limitation portion into a first position limitation portion and a second position limitation portion; the electronic rotation core is of a multiple-segment cylindrical shape, wherein one end of the electronic rotation core is a rear end, and at the rear end there are electronic contacts, with the front end of the electronic rotation core being inserted into the first cavity so as to be rotationally connected with the mechanical rotation core, and, an electronic control unit and an electromagnet is disposed in the electronic rotation core, wherein the electronic control unit is connected with the electronic contacts and the electromagnet respectively and controls the action of the electromagnet; a through hole for telescoping of a core of the electromagnet is provided at a position where the front end of the electronic rotation core mates with the concave or recessed portion, and a spring is disposed inside the electronic rotation core such that the core abuts against the spring so as to be projected; a cambered side slot is provided at the front end of the electronic rotation core in the circumferential direction and is used to mate with the cambered position limitation portion, wherein the side slot mates with the cambered position limitation portion in an axial direction, and the side slot is provided with an electronic rotation core retainer slot in the axial direction of the electronic rotation core, dividing the side slot into a first side slot corresponding to the first position limitation portion and a second side slot corresponding to the second position limitation portion, wherein the arc length of the first side slot is larger than or equal to that of the first position limitation portion, and the arc length of the second side slot is larger than or equal to the sum of the arc length of the second position limitation portion and the width of the mechanical rotation core retainer slot; an inner wall of the housing has a housing retainer slot in the axial direction; when locking, the core is projected into the concave or recessed portion, and the housing retainer slot is aligned with the mechanical rotation core retainer slot while staggered with the electronic rotation core retainer slot, wherein the retainer rod is seated within both of the housing retainer slot and the mechanical rotation core retainer slot at the same time; when unlocking, the core is retracted into the electronic rotation core, the electronic rotation core rotates by a certain angle to align the electronic rotation core retainer slot with the mechanical rotation core retainer slot, wherein the retainer rod is moved toward the electronic rotation core retainer slot and is seated within both of the electronic rotation core retainer slot and the mechanical rotation core retainer slot at the same time, enabling the electronic rotation core and the mechanical rotation core to rotate synchronously.

Preferably, a Hall sensor is further disposed inside the electronic rotation core, wherein the Hall sensor is placed at the position that is outside of the circle center of the front end surface of the electronic rotation core; and at the bottom portion of the first cavity, there is a magnet at the position corresponding to the Hall sensor.

Preferably, at the opening of the front end of the housing, there is a triangular retainer block that is used to limit the rotation angle of the deflector rod.

Preferably, further comprises an end sealing and a circular platen, wherein a circular sliding recess is provided at a front end of the end sealing, and the end sealing is positioned at the rear end of the housing and is fixedly connected with the housing; and the platen is fixedly connected to the rear end of the electronic rotation core, and the platen is positioned within the sliding recess.

Preferably, the wall of the electronic rotation core retainer slot and/or that of the housing retainer slot are/is slope(s).

Preferably, the arc length of the first position limitation portion is equal to that of the second position limitation portion.

An electronic lock system according to the present invention is further provided, comprising the above mentioned electronic lock cylinder, and an electronic key, a lock body, and a U-shaped main retainer rod; the electronic key includes a key rod and a key housing; at the middle upper portion of the key rod there is a rotation guide channel in the radial direction, and an outer wall of a top portion of the key rod has a guide channel provided in the axial direction which is communicated with the rotation guide channel; an insertion end of the key rod is provided with key contacts; when unlocking, the electronic key is inserted into the electronic lock cylinder, and the key contacts of the electronic key are communicated with the electronic contacts inside the electronic lock cylinder; key chips are disposed inside the key housing, and the key chips are connected to the key contacts via wires; a battery is provided inside the key housing to supply electricity to the key chips; an inclined recess is provided at inner side of the main retainer rod; the lock body has a lock cylinder mounting hole and two main retainer rod holes, wherein, there is a through hole between the inner wall of the lock cylinder mounting hole and the main retainer rod holes, and the through hole matches with the inclined recess, i.e. the position at which the deflector rod of the electronic lock cylinder is located; inside the through hole, there are retainer balls; and the electronic lock cylinder is disposed in the lock cylinder mounting hole of the lock body, and the deflector rod of the electronic lock cylinder corresponds to the position of the retainer balls so as to poke the retainer balls to clamp or release the main retainer rod.

Another technical problem to be solved by the present invention is to provide an unlocking method which can accurately record actual unlocking activities.

To solve the technical problem of accurately recording the unlocking activities, the present invention provides an unlocking method for an electronic lock system, wherein the unlocking method includes the following steps sequentially executed:

S11: the key contacts of the electronic key contact with the electronic contacts of the electronic rotation core, interchanging authority data and verifying the authority;

S12: determining if the access authority verification is successful or not, and if yes, proceeding to step S131, and if no, proceeding to step S132;

S131: the battery inside the electronic key supplies electricity to the electromagnet that is inside the electronic rotation core, and the core of the electromagnet is retracted into the electronic rotation core after the electromagnet is electrified, and proceeding to step S14;

S132: stopping unlocking;

S14: rotating the electronic rotation core with the electronic key, and the electronic rotation core drives the mechanical rotation core to rotate so as to make the deflector rod poke the retainer balls to release the main retainer rod.

Preferably, performing the following step while executing step S14:

after the electronic control unit in the electronic rotation core receives the rotation signal of the electronic rotation core detected by the Hall sensor, it records the information on the person unlocking the lock and stores the information.

More preferably, performing the following step while executing step S14:

after the electronic control unit in the electronic rotation core receives the rotation signal of the electronic rotation core detected by the Hall sensor, the electronic control unit breaks a circuit of the electromagnet.

The present invention has the following beneficial effects compared with the prior art.

(1) Axial fixation is realized between the electronic rotation core and mechanical rotation core with the core of the electromagnet, and when compared with a motor, in the present invention, the electromagnet is of a high responding speed, moreover, the electronic rotation core is rotated manually, which makes it unnecessary to have a motor and simplifies the structure, significantly reducing the volume of the electronic lock cylinder.

(2) Detecting if the electronic lock cylinder rotates or not by using the Hall sensor and cutting off electricity immediately after the rotation is detected, thereby saving electric energy and increasing the usage life of battery.

(3) The unlocking record is accurate, since the Hall Sensor detects if the electronic lock cylinder rotates or not and the unlocking activities are recorded and stored only when the electronic lock cylinder actually rotates.

DETAIL DESCRIPTION

Detail description of the present invention will be given with reference to specific embodiments and the accompanying drawings, while not limiting the present invention.

Figure 1:
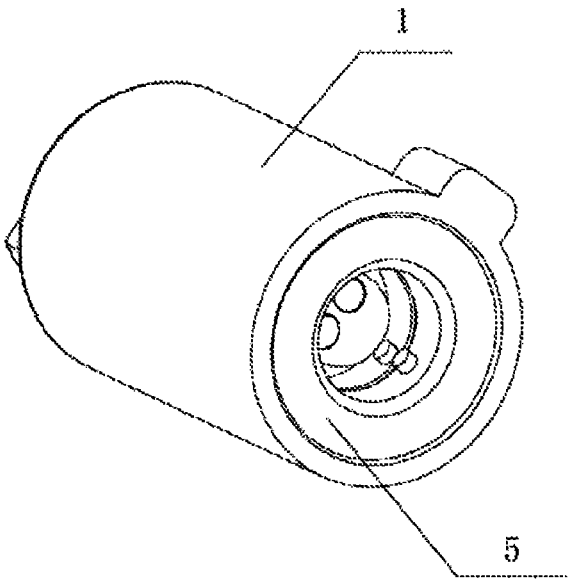
FIG. 1 is a diagrammatic view of an overall structure of the electronic lock cylinder according to an embodiment of the present invention.
Figure 2:
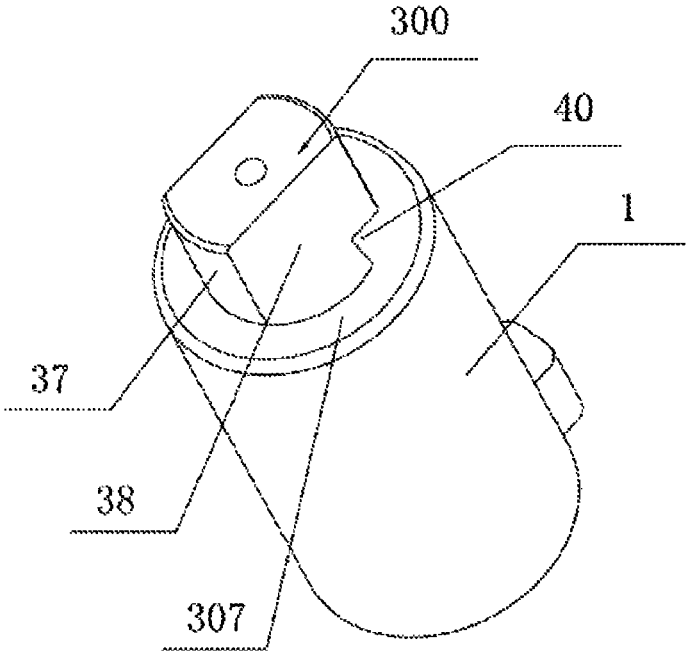
FIG. 2 is a diagrammatic view of an overall structure of the electronic lock cylinder shown in FIG. 1 in another direction.
Figure 3:
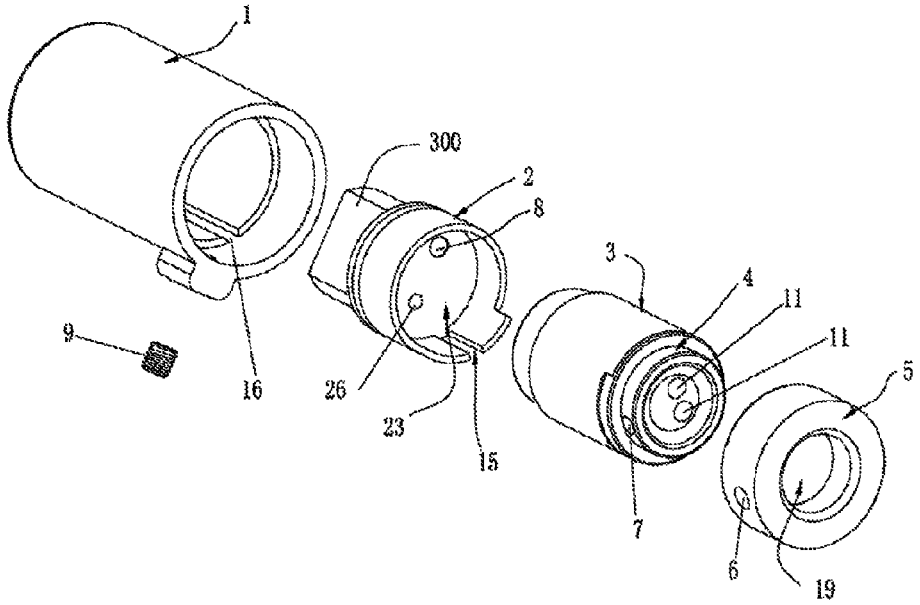
FIG. 3 is an exploded diagrammatic view of the electronic lock cylinder shown in FIG. 1.
Figure 4:
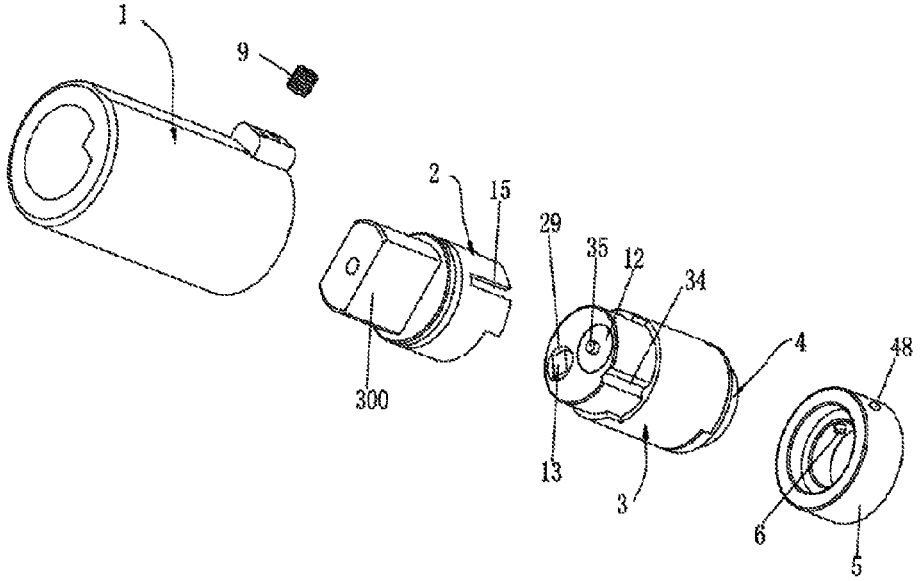
FIG. 4 is an exploded diagrammatic view of FIG. 3 in another direction.
Figure 5:
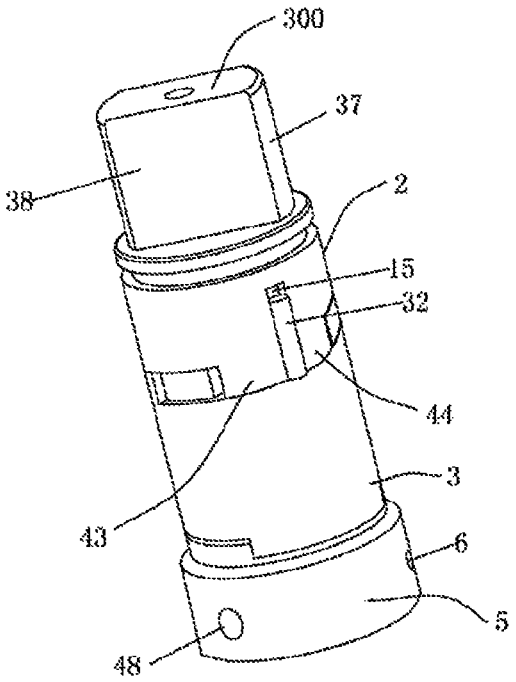
FIG. 5 is a structural diagrammatic view of the electronic lock cylinder shown in FIG. 1 with the housing removed.
Figure 6:
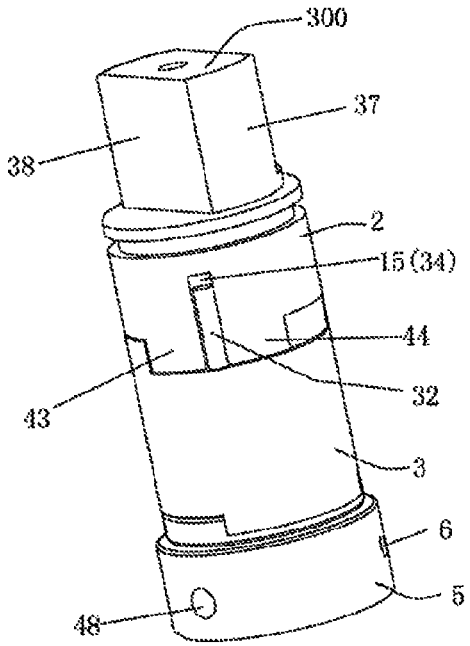
FIG. 6 is a diagrammatic view of FIG. 5 in another direction.
Figure 7:
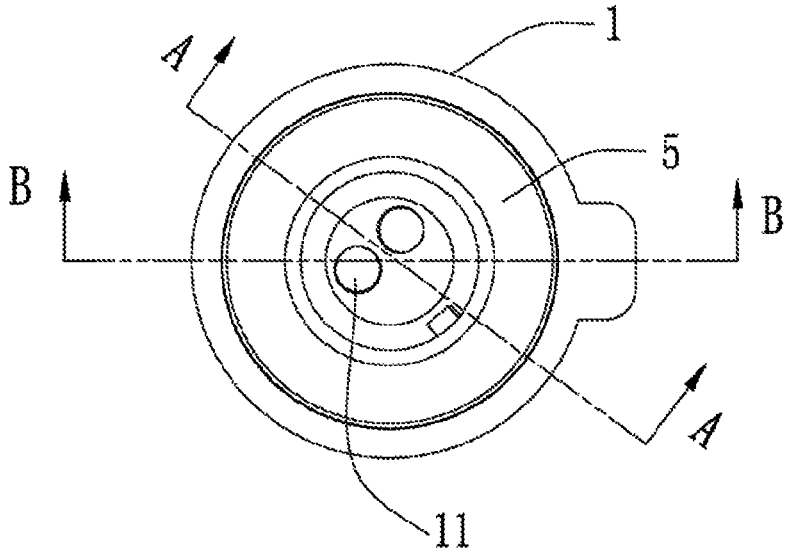
FIG. 7 is a diagrammatic view of the electronic lock cylinder shown in FIG. 1 viewed from the direction of the end sealing.

As shown in FIGS. 1-13, an electronic lock cylinder according to one embodiment of the present invention includes: a mechanical rotation core 2, an electronic rotation core 3, a barrel-shaped housing 1 with both ends opened for accommodating the mechanical rotation core 2 and the electronic rotation core 3, and a retainer rod 32 (for the sake of brief drawing, the retainer rod 32 is not shown in FIG. 3 and FIG. 4, instead, the detail description thereof is provided in FIG. 5 and FIG. 6). As shown in FIG. 2, one end of the housing 1 is the front end, and at the opening of the front end there is a position limitation chuck 307 for axial position limitation. In the present embodiment, the position limitation chuck 307 is formed by bending inwardly at the opening of one end of the housing 1, for axial position limitation of the internal components. As shown in FIG. 3, the inner wall of the housing 1 is provided with a housing retainer slot 16 axially. Noted that, in the claims and the description of the present invention, in order to describe conveniently, the "front end" and the "rear end" used throughout are defined according to the following rules: as for an electronic lock cylinder, in an axial direction of the electronic lock cylinder, the "rear end" thereof refers to the end for insertion of the key, while the "front end" thereof refers to the end for poking other components of the lock so as to unlock the lock. The "front end" and the "rear end" of other components such as the mechanical rotation core 2, the electronic rotation core 3 and the housing 1 have the same meaning as that defined above, that is, the "rear end" thereof is closer to the end of the electronic lock cylinder for inserting the key compared with the "front end".

As shown in FIGS. 2-5, the front end of the mechanical rotation core 2 is a flat deflector rod 300 including a relatively wide wide-surface 38 and a relatively narrow narrow-surface 37, wherein the narrow-surface 37 is used to abut against other components, and, in order to mate with other components better, the narrow-surface 37 is a cambered surface. The deflector rod 300 is projected out of the front end of the housing 1, and the rear end of the mechanical rotation core 2 is a first cylindrical cavity 23, wherein at the position outside of the circle center of the bottom portion of the first cavity 23, there is a concave or recessed portion 26; a segment of the wall of the first cavity 23 protrudes in its axial direction, forming a cambered position limitation portion, and at the middle portion of the cambered position limitation portion, there is a through mechanical rotation core retainer slot 15 that is in parallel with the axis of the first cavity 23 and divides the cambered position limitation portion into a first position limitation portion 43 and a second position limitation portion 44.

As shown in FIGS. 3-5, the electronic rotation core 3 is of multiple-segment cylindrical shape, and at the rear end of the electronic rotation core 3 there are two electronic contacts 11, with the front end of the electronic rotation core 3 being inserted into the first cavity 23 so as to be rotationally connected with the mechanical rotation core 2. The structure of the electronic rotation core 3 is further described below with reference to FIGS. 8-11, and an electronic control unit (not shown in the drawings) and an electromagnet 12 are disposed inside the electronic rotation core 3, wherein the electronic control unit is provided on a circuit board 10, and the electronic control unit is connected with the electronic contacts 11 and the electromagnet 12 respectively and controls actions of the electromagnet 12. As shown in FIGS. 4, 9 and 10, a through hole for telescoping of the core 35 of the electromagnet 12 is provided at a position where the front end of the electronic rotation core 3 and the concave or recessed portion 26 mate, and a spring 301 is disposed inside the electronic rotation core 3 such that the spring 301 abuts against the core 35 so as to projects the core 35. The core 35 also serves as a clamping component clamped in the concave or recessed portion 26. And when the electricity supplied to the electromagnet 12 is cut off, the core 35 is projected out of the electronic rotation core 3 and is positioned in the concave or recessed portion 26, enabling the electronic rotation core 3 and the mechanical rotation core 2 to rotate synchronously only. In order to achieve the aim of rotating the electronic rotation core 3 and the mechanical rotation core 2 synchronously by providing only one core 35 in the axial direction, the concave or recessed portion 26 and the corresponding core 35 must be disposed at the portion departing from the circle center.

Figure 11:
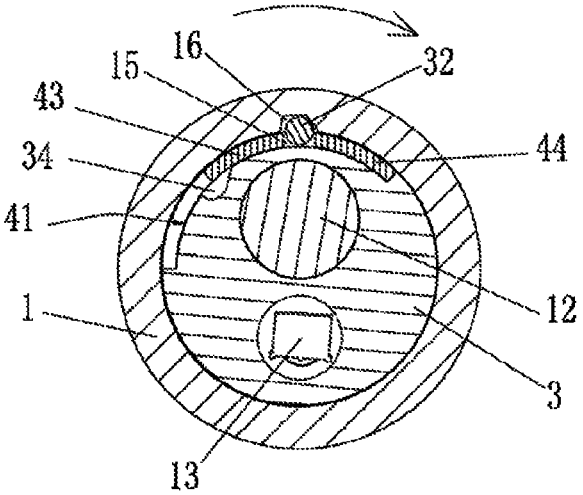
FIG. 11 is a sectional view of the electronic lock cylinder in FIG. 1 cut from the portion where the electronic rotation core and the mechanical rotation core join in the plane direction perpendicular to the axial direction of the electronic lock cylinder (locking state)
Figure 12:
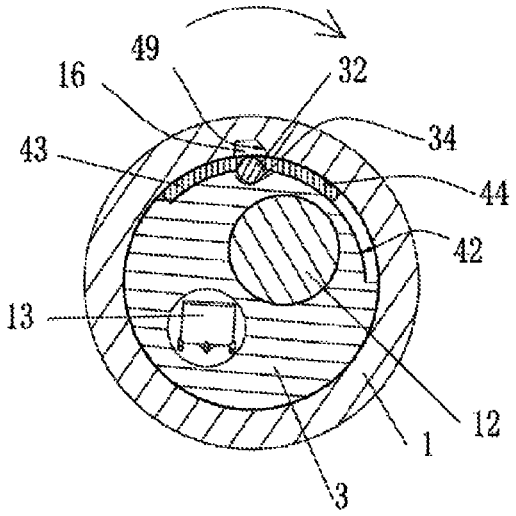
FIG. 12 is a diagrammatic view at the time when rotating the electronic rotation core during unlocking the lock.
Figure 13:
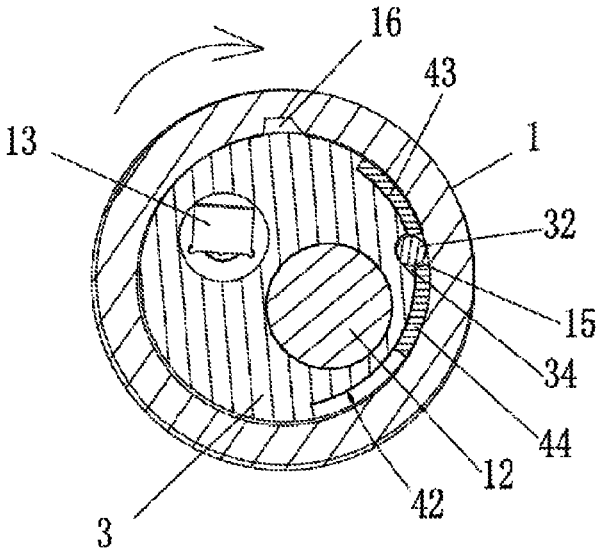
FIG. 13 is a diagrammatic view in the state of complete unlocking after the electronic rotation core drives the mechanical rotation core to rotate in FIG. 11.
Figure 14:
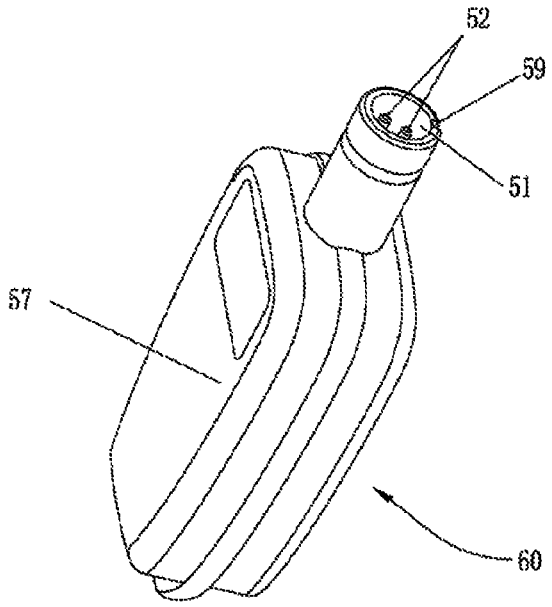
FIG. 14 is a structural diagrammatic perspective view of the electronic key according to an embodiment of the present invention.
Figure 15:
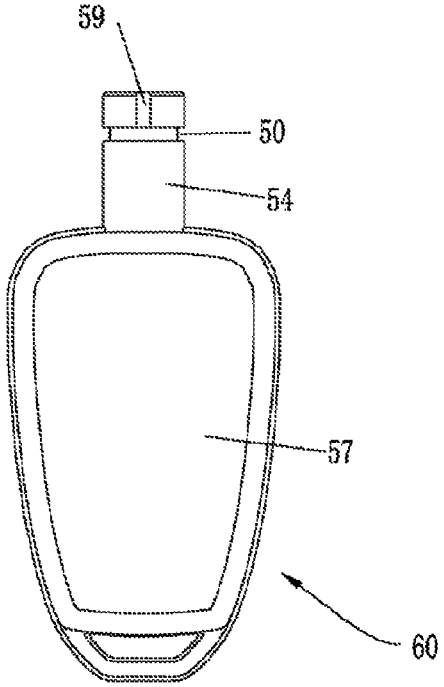
FIG. 15 is a plan view of FIG. 14.
Figure 16:
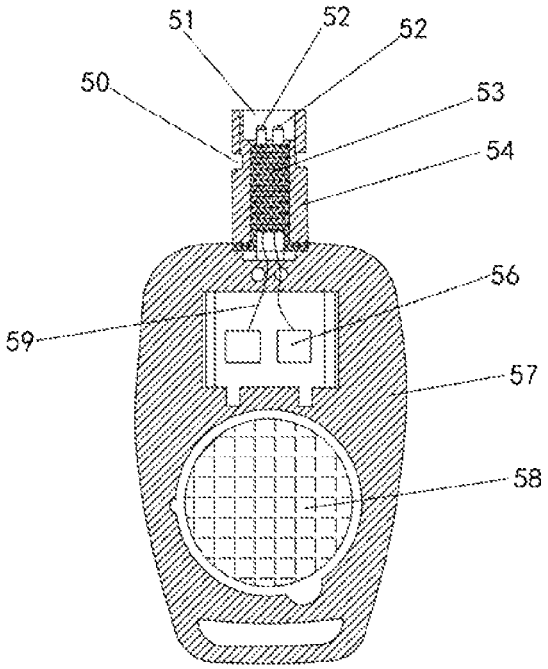
FIG. 16 is a diagrammatic view of the internal structure of FIG. 14.

With reference to FIG. 4 and taking FIG. 11 and FIG. 12 into account to continue illustrate the mating between the mechanical rotation core 2 and the electronic rotation core 3, the front end of the electronic rotation core 3 is provided with a cambered side slot in the circumferential direction for mating with the cambered position limitation portion in the axial direction, so as to ensure that the electronic rotation core 3 and the mechanical rotation core 2 can rotate through a certain angle with respect to each other. The side slot is provided with an electronic rotation core retainer slot 34 in the axial direction of the electronic rotation core 3, dividing the side slot into a first side slot 41 corresponding to the first position limitation portion 43 and a second side slot 42 corresponding to the second position limitation portion 44, while satisfying the geometrical relations in the following two aspects: (1) the arc length of the first side slot 41 is larger than or equal to that of the first position limitation portion 43; and (2) the arc length of the second side slot 42 is larger than or equal to the sum of the arc length of the second position limitation portion 44 and the width of the mechanical rotation core retainer slot 15.

The geometrical relation of the two aspects above is to ensure that the electronic rotation core 3 and the mechanical rotation core 2 can rotate through a certain angle with respect to each other, as explained below by referring to FIGS. 11-12 and in connection with FIGS. 5-6.

As shown in FIG. 12, when the electronic rotation core 3 and the mechanical rotation core 2 are rotating with respect to each other, at the time when the first position limitation portion 43 abuts against the side of the first side slot 41, the electronic rotation core retainer slot 34 can align with the mechanical rotation core retainer slot 15, and the retainer rod 32 is moved into the electronic rotation core retainer slot 34 and is seated within both of the electronic rotation core retainer slot 34 and the mechanical rotation core retainer slot 15 at the same time, thus realizing the synchronous rotating of the electronic rotation core 3 and the mechanical rotation core 2. On the contrary, if the arc length of the first side slot 41 is smaller than that of the first position limitation portion 43, with reference to FIG. 12, it is contemplated that, at this time, the first position limitation portion 43 is overlying the electronic rotation core retainer slot 34, and the electronic rotation core retainer slot 34 cannot be aligned with the housing retainer slot 16 even if the electronic rotation core retainer slot 34 is further rotated, as a result, the present invention cannot be realized. As for FIG. 5 and FIG. 6, it is to be noted that, in FIG. 5, the mechanical rotation core retainer slot 15 is staggered with the electronic rotation core retainer slot 34, while in FIG. 6, with the rotation of the electronic rotation core 3, the mechanical rotation core retainer slot 15 is right opposite to the electronic rotation core retainer slot 34, thus, the lines of the reference signs of the electronic rotation core retainer slot 34 and the mechanical rotation core retainer slot 15 are overlapped.

With reference to FIG. 11, the mechanical rotation core retainer slot 15 and the retainer rod 32 are located above the second side slot 42 when the second position limitation portion 44 abuts against the edge of the second side slot 42, so that the mechanical rotation core 2 is fixed with respect to the housing 1, and the mechanical rotation core 2 cannot rotate. According to the direction of the arrow indicated in the drawing, rotating the electronic rotation core 3 clockwise can make the electronic rotation core retainer slot 34 align with the mechanical rotation core retainer slot 15. When the arc length of the second side slot 42 is equal to the sum of the arc length of the second position limitation portion 44 and the width of the mechanical rotation core retainer slot 15, at the time when the second position limitation portion 44 abuts against the edge of the second side slot 42, the mechanical rotation core retainer slot 15 is right opposite to one side of the electronic rotation core retainer slot 34, enabling that the retainer rod 32 is about to enter into the electronic rotation core retainer slot 34. In other words, with reference to FIG. 11, the arc length of the second side slot 42 must satisfy that the electronic rotation core retainer slot 34 is positioned behind the mechanical rotation core retainer slot 15 (clockwise direction is referred as the front), and only in this way, when rotating electronic rotation core 3 clockwise, moving of the retainer rod 32 can be realized, so as to enable the retainer rod 32 to enter into the electronic rotation core retainer slot 34 and at the same time be located in the mechanical rotation core retainer slot 15, thus realizing the synchronous rotation of the electronic rotation core 3 and the mechanical rotation core 2. Meantime, the electronic rotation core of the present invention should also satisfy the following combining relation: when locking, the core 35 is projected into the concave or recessed portion 26, wherein the housing retainer slot 16 is aligned with the mechanical rotation core retainer slot 15 while staggered with the electronic rotation core retainer slot 34, and the retainer rod 32 is located in both of the housing retainer slot 16 and the mechanical rotation core retainer slot 15 at the same time, so as to realize that the mechanical rotation core 2 and the housing 1 are fixedly connected without rotating with respect to each other, and the mechanical rotation core 2 is fixed to the housing 1; when unlocking, the core 35 is retracted into the electronic rotation core 3, and rotating the electronic rotation core 3 counterclockwise by a certain angle, to align the mechanical rotation core retainer slot 15 with the electronic rotation core retainer slot 34, wherein the retainer rod 32 is seated within both of the electronic rotation core retainer slot 34 and the mechanical rotation core retainer slot 15 at the same time, thus realizing the synchronous rotation of the electronic rotation core 3 and the mechanical rotation core 2, and further rotating the electronic rotation core 3, the mechanical rotation core 2 begins to rotate by being driven by the electronic rotation core 3, and the deflector rod 300 of the mechanical rotation core 2 begins to rotate, poking other relating components to realize unlocking. The process of poking other relating components by the deflector rod 300 is the same as that in the prior art, thus detailed description thereof will not be repeated.

The present invention uses the core 35 of the electromagnet to realize the clamping between the electronic rotation core 3 and the mechanical rotation core 2. When no electricity is supplied, the electronic rotation core 3 and the mechanical rotation core 2 are clamped via the core 35 and cannot rotate with respect to each other, and the mechanical rotation core 2 and the housing 1 are caught via the retainer rod 32 and cannot rotate with respect to each other, while the deflector rod 300 of the mechanical rotation core 2 cannot rotate, realizing the locking. When unlocking, there are three steps, the first step: the core 35 is retracted, allowing the separation between the electronic rotation core 3 and the mechanical rotation core 2, and at this time, the mechanical rotation core 2 is fixed to the housing 1 with the retainer rod 32; the second step: rotating the electronic rotation core 3 with the key manually, and at this time, the electronic rotation core 3 rotates relative to the mechanical rotation core 2, and when rotating to a certain angle, the mechanical rotation core retainer slot 15 opposes to the electronic rotation core retainer slot 34, and the retainer rod 32 is freed from the mechanical rotation core retainer slot 15 and into the electronic rotation core retainer slot 34, and is located within both of the mechanical rotation core retainer slot 15 and the electronic rotation core retainer slot 34, allowing the synchronous rotation of the electronic rotation core 3 and the mechanical rotation core 2, and at this time, realizing the disengagement between the mechanical rotation core 2 and the housing 1; and, the third step: the mechanical rotation core 2 can rotate with the electronic rotation core 3, driving the deflector rod 300 to rotate and realizing unlocking, in this manner, these three steps are executed sequentially, with better anti-theft performance. As the present invention uses an electromagnet, when comparing with the aspect adopting a motor, the present invention increases the responding speed, simplifies the structure, and significantly reduces the volume of the electronic lock cylinder. And because there is no electric energy consumption when rotating the electronic rotation core, the life of the battery can be increased.

As a preferable aspect, in the present embodiment, a Hall sensor 13 is provided in the electronic rotation core 3, and the Hall sensor 13 is placed at the portion which is outside of the circle center of the front end surface of the electronic rotation core 3; a magnet 8 is provided at the position of the bottom portion of the first cavity 23 that is opposite to the Hall sensor 13. The magnet 8 provides inductive magnetic field for the Hall sensor 13, and when the electronic rotation core 3 and the mechanical rotation core 2 rotate relatively, the Hall sensor 13 emits signals to the electronic control unit disposed in the electronic rotation core 3. When the electronic rotation core 3 and the mechanical rotation core 2 rotate relatively, it is not necessary to supply electricity to the electromagnet 12, and the electronic control unit turns off the circuit of the electromagnet 12, which can further save electric energy. Moreover, the electronic control unit uses the Hall sensor 13 to monitor if the electronic rotation core 3 rotates, and only when the electronic rotation core 3 rotates, the unlocking record is stored. And the unlocking record including the persons who unlocks the lock, unlocking time and so on, can be stored in the electronic rotation core 3 or in the electronic key, and the unlocking record can also be stored in both of the electronic rotation core 3 and the electronic key. This prevents the case in which it is recorded even if the electronic key is inserted but the lock is not unlocked actually, allowing the unlocking activities to be recorded objectively and truly.

As shown in FIG. 2, preferably, in the present embodiment, at the opening of the front end of the housing 1 there is a triangular retainer block 40 for limiting the rotation angle of the deflector rod 300. The retainer block 40 can function to limit the rotation angle of the deflector rod 300 so as to increase its using performance.

Figure 8:
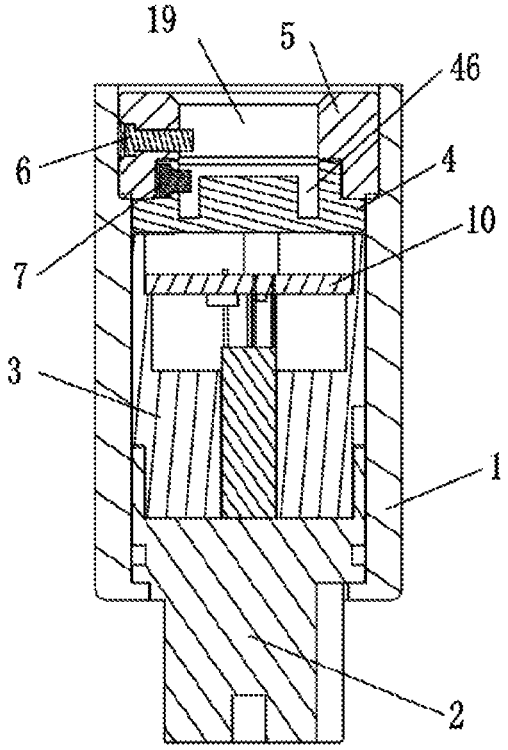
FIG. 8 is a sectional view along the direction of A-A in FIG. 7 (the core of the electromagnet projecting into the concave or recessed portion, in a locking state)
Figure 9:
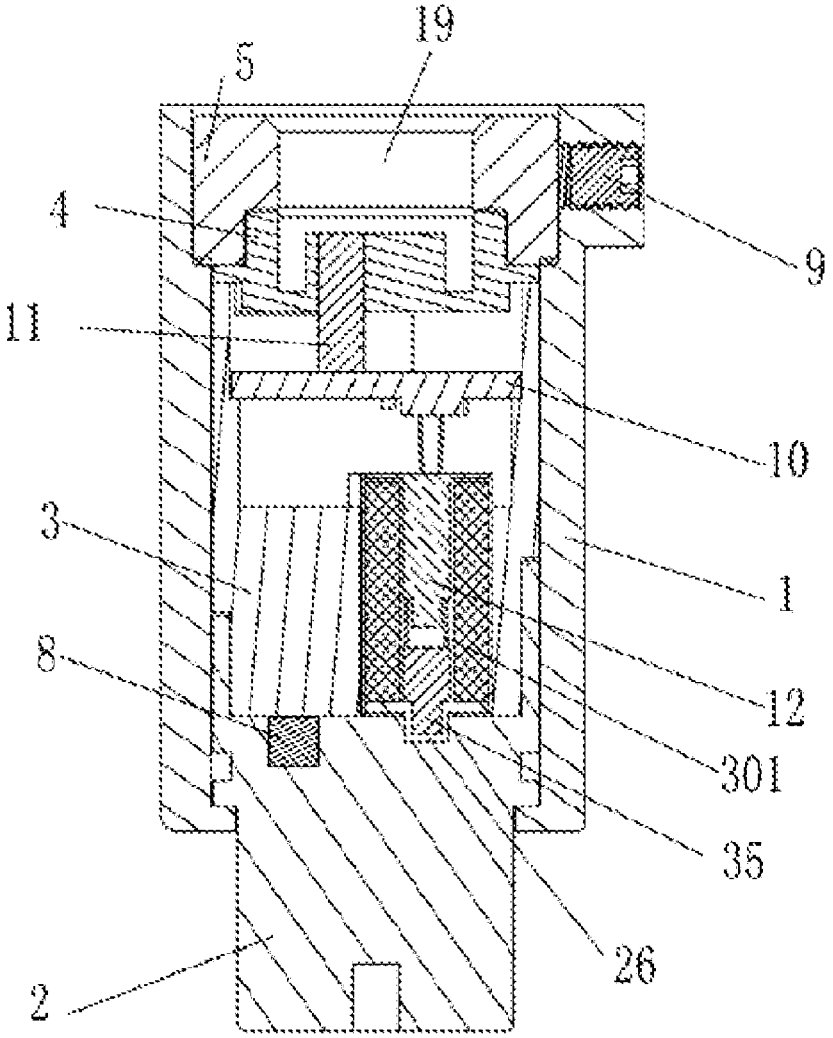
FIG. 9 is a sectional view along the direction of B-B in FIG. 7 (the core of the electromagnet projecting into the concave or recessed portion, in a locking state)
Figure 10:
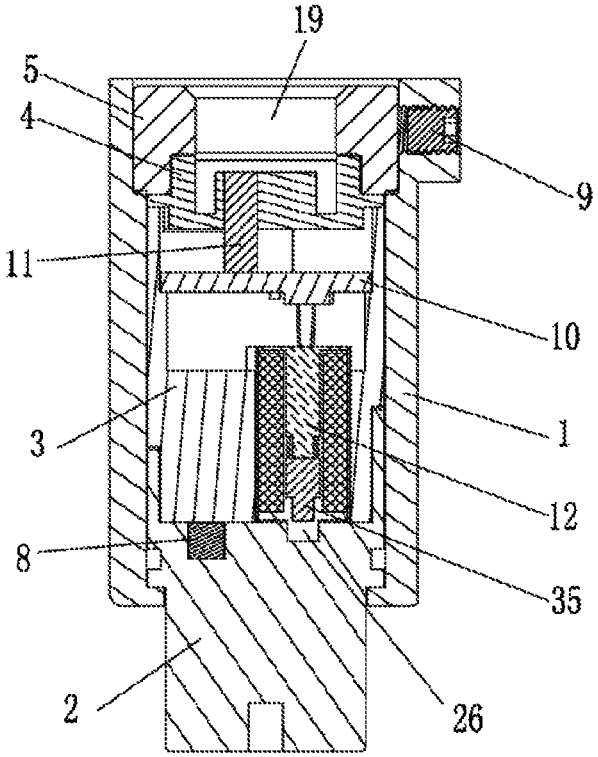
FIG. 10 is a sectional view along the direction of B-B in FIG. 7 (at the time when the electromagnet is supplied with electricity, and the core is retracted into the electronic lock cylinder, beginning to rotate the electronic rotation core to unlock)

As shown in FIGS. 1-10, the electronic lock cylinder of the present embodiment further includes an end sealing 5 and a circular platen 4, and the end sealing 5 has a circular sliding recess provided at the front end, with the end sealing 5 locating at the rear end of the housing 1 and fixedly connected to the housing 1, and as shown in FIGS. 3-10, the end sealing 5 is provided with a radial connecting hole 48 so as to be fixedly connected to the housing 1 with a screw 9, and the internal of the end sealing 5 is a cavity 19 into which the key rod of the electronic key enters; the end sealing 5 is provided with an end sealing pin 6 in the radial direction thereof, and the end sealing pin 6 is projected into the end sealing 5 as a portion of the cavity (the function thereof will be described later). As shown in FIG. 4, the platen 4 is fixedly connected to the rear end of the electronic rotation core 3, and is located in the sliding recess. By providing the circular platen 4, and by forming a platen cavity 46 therein, a space is provided for mounting electronic contacts 11 and functions to protect the electronic contacts 11, and the platen 4 and the electronic rotation core 3 are integral, the electronic key being engaged with the platen 4 in order to make the electronic key drive the electronic rotation core 3 to rotate (the cooperation relation between the electronic key and the electronic rotation core will be described in detail below). In the present embodiment, as shown in FIG. 8, the platen 4 is provided with a platen pin 7 in the radial direction thereof, for engaging with the electronic key.

As shown in FIG. 3 and FIGS. 11-13, preferably, in the present embodiment, the wall of the electronic rotation core retainer slot 34 is a slope, and the wall of the housing retainer slot 16 is also a slope, facilitating the retainer rod 32 to slide in and out.

Preferably, in the present embodiment, the arc lengths of the first position limitation portion 43 and the second position limitation portion 44 are equal, and the arc length of the second side slot 42 is twice of that of the first side slot 41. As shown in FIG. 11 and FIG. 12, it can ensure that when unlocking and locking, the rotation angles at which the electronic key drives the electronic rotation core 3 to rotate clockwise or counterclockwise are the same, conforming to the common habit. An electronic lock system according to one embodiment of the present invention will be described with reference to FIGS. 14-21 and by referring to the above description of the structure of the electronic lock cylinder, and the electronic lock system includes an electronic lock cylinder 600, an electronic key 60, a lock body 500, and a U-shaped main retainer rod 501. The electronic key 60 includes a key rod 54 and a key housing 57. The middle upper portion of the key rod 54 is provided with a rotation guide channel 50 in the radial direction, and the outer wall of the top portion of the key rod 54 is provided with a guide channel 59 in the axial direction, with the guide channel 59 opening until communicating with the rotation guide channel 50. The insertion end of the key rod 54 is the accommodating space 51 for accommodating the key contacts 52 in which the key contacts 52 being provided therein, with two key contacts 52 mounting on the contact mounting base 53 which is located in the key rod 54 and disposed in the axial direction. In order to achieve better electronic contact property, preferably, in the present embodiment, the key contacts 52 are elastic contacts. When unlocking, the electronic key 60 is inserted into the electronic lock cylinder 600, and the key contacts 52 of the electronic key 60 are communicated with the electronic contacts 11 inside the electronic lock cylinder 600. The mechanical cooperation relation between the electronic key 60 and the electronic lock cylinder will be described with reference to FIGS. 1, 3, 4, 9 and 10. When intending to unlock, at the time when the insertion end of the key rod 54 is to be inserted into the cavity 19 inside the end sealing 5, the guide channel 59 should be aligned with the end sealing pin 6, and only in this state, the insertion can be secured, and at the time when the key rod 54 is inserted to the end, the rotation guide channel 50 just arrives at the position of the end sealing pin 6, and at this time, the electronic key 60 can be rotated, with the free end of the end sealing pin 6 sliding in the rotation guide channel 50. And at this time, the platen pin 7 is stuck in the guide channel 59, and by rotating the key rod 54 manually, the key rod 54 drives the platen 4 to rotate through the platen pin 7, while the electronic rotation core 3 fixedly connected to the platen 4 also begins to rotate. In locking state, the end sealing pin 6 and the platen pin 7 are positioned in the same line in the axial direction of the electronic rotation core 3, ensuring that the guide channel 59 of the key rod 54 can sequentially mate with the end sealing pin 6 and the platen pin 7, and when the guide channel 59 and the platen pin 7 are mating, the end sealing pin 6 mates with the rotation guide channel 50, and at this time, the key rod 54 can be rotated, and the end sealing pin 6 and the platen pin 7 are no longer positioned in the same line. While in unlocking state, since the guide channel 59 of the key rod 54 mates with the platen pin 7, the key rod 54 is stuck by the platen pin 7, and the key rod 54 cannot be pulled out freely, and under such condition, only by rotating the key rod 54 counterclockwise, that is, from the unlocking state returning to the locking state, the end sealing pin 6 and the platen pin 7 are positioned on the same line again (parallel to the axial direction of the electronic rotation core 3), and at this time, the key rod 54 can be pulled out.

Inside of the key housing 57, there are key chips 56 (the structure thereof will be described below), and the key chips 56 are connected to the key contacts 52 via wires 60; and inside of the key housing 57, there is a battery 58 to supply electricity to the key chips 56.

The lock body 500 has a lock cylinder mounting hole 530 into which the electronic lock cylinder 600 is disposed. The deflector rod 300 of the electronic lock cylinder 600 corresponds to the position of the retainer ball 521 so as to poke the retainer ball 521 to clamp or release the main retainer rod 501.

The lock body 500 has two main retainer rod holes (not shown in the drawings) provided therein for mounting the main retainer rod 501, and there is a through hole between the inner wall of the lock cylinder mounting hole 530 and the two main retainer rod holes respectively, while in the through hole, a first retainer ball 521 and a second retainer ball 522 are provided. The main retainer rod 501 is of U-shape, and has a first recess 511 and a second recess 512 (i.e. inclined recesses), provided at the inner side respectively. The first recess 511 and the second recess 512 fit into the positions of the through holes which can be dimensioned to accommodate the first retainer ball 521 and the second retainer ball 522. In locking state, one side of the first and the second retainer balls 521, 522 is abut against by the narrow surface 37 of the deflector rod 300, and the other side thereof is abut against by the first recess 511 and the second recess 512. In locking state, the wide surface 38 of the deflector rod 300 opposes directly to the first retainer ball 521 and the second retainer ball 522, raising the main retainer rod 501 to unlock. If an elastic component is provided at the bottom portion of the main retainer rod hole, automatic popping up of the main retainer rod 501 can be achieved.

Figure 19:
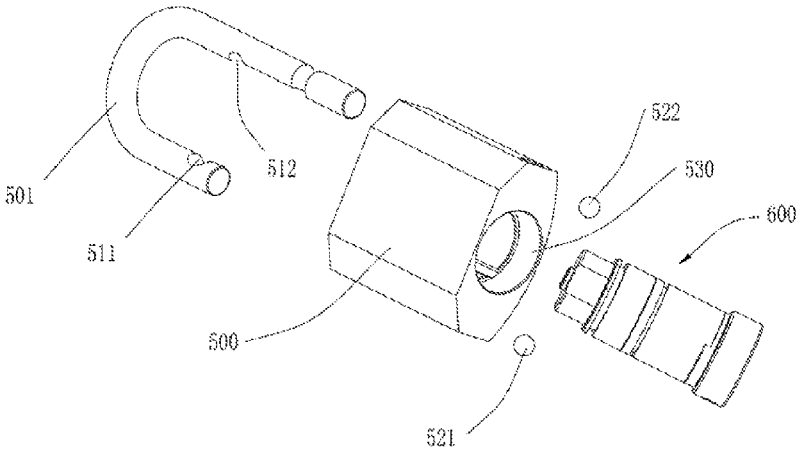
FIG. 19 is an exploded structural diagrammatic view of the padlock to which the electronic lock cylinder (with the housing removed) of the present invention is applied.
Figure 20:
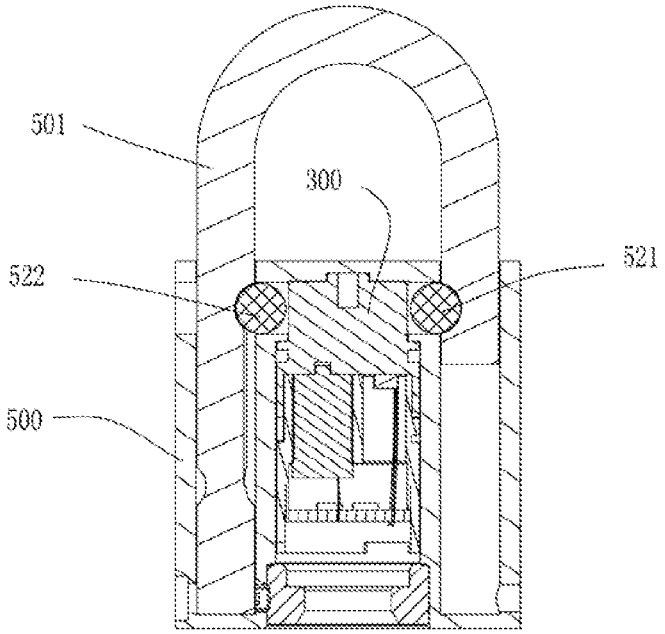
FIG. 20 is a cross-sectional diagrammatic view of a padlock to which the electronic lock cylinder of the present invention is applied (locking state)
Figure 21:
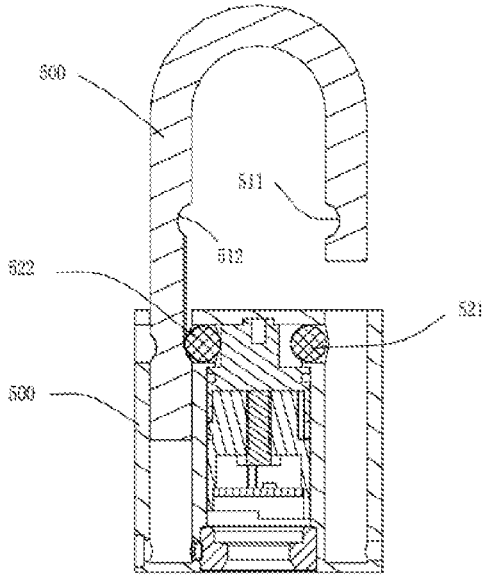
FIG. 21 is a cross-sectional diagrammatic view of a padlock to which the electronic lock cylinder of the present invention is applied (unlocking state)

To be noted that, the housing 1 of the electronic lock cylinder 600 is not included in FIG. 19, and the housing 1 is replaced with the lock body 500 to realize its function, and in the inner wall of the lock cylinder mounting hole 530 there is a slot that is of the same shape as the shape of the housing retainer slot 16 of the housing 1. In practice, if the lock cylinder mounting hole 530 is mounted with an electronic lock cylinder including the housing 1, the same function can also be realized, while requiring that the housing 1 and the lock body 500 are fixedly connected. As shown in FIG. 19, when the housing 1 is not used, the function of the housing 1 is realized by the lock body 500, and in the inner wall of the lock cylinder mounting hole 530, there is a slot that is of the same shape as the shape of the housing retainer slot 16 of the housing 1. In this case, in order to avoid offside of the deflector rod 300, a positioning-limiting rod (not shown in the drawings) can be provided at the bottom portion of the lock cylinder mounting hole 530, with the positioning-limiting rod protruding from the bottom portion of the lock cylinder mounting hole 530, and the function of the positioning-limiting rod is the same as that of the retainer block 40 of the housing 1, so its description will not be repeated. In addition, the mounting staple for fixedly connecting the electronic lock cylinder 600 to the lock body 500 is not shown in FIG. 19, and this is the technical common knowledge for a person skilled in the art, and will not be repeated.

Figure 17:
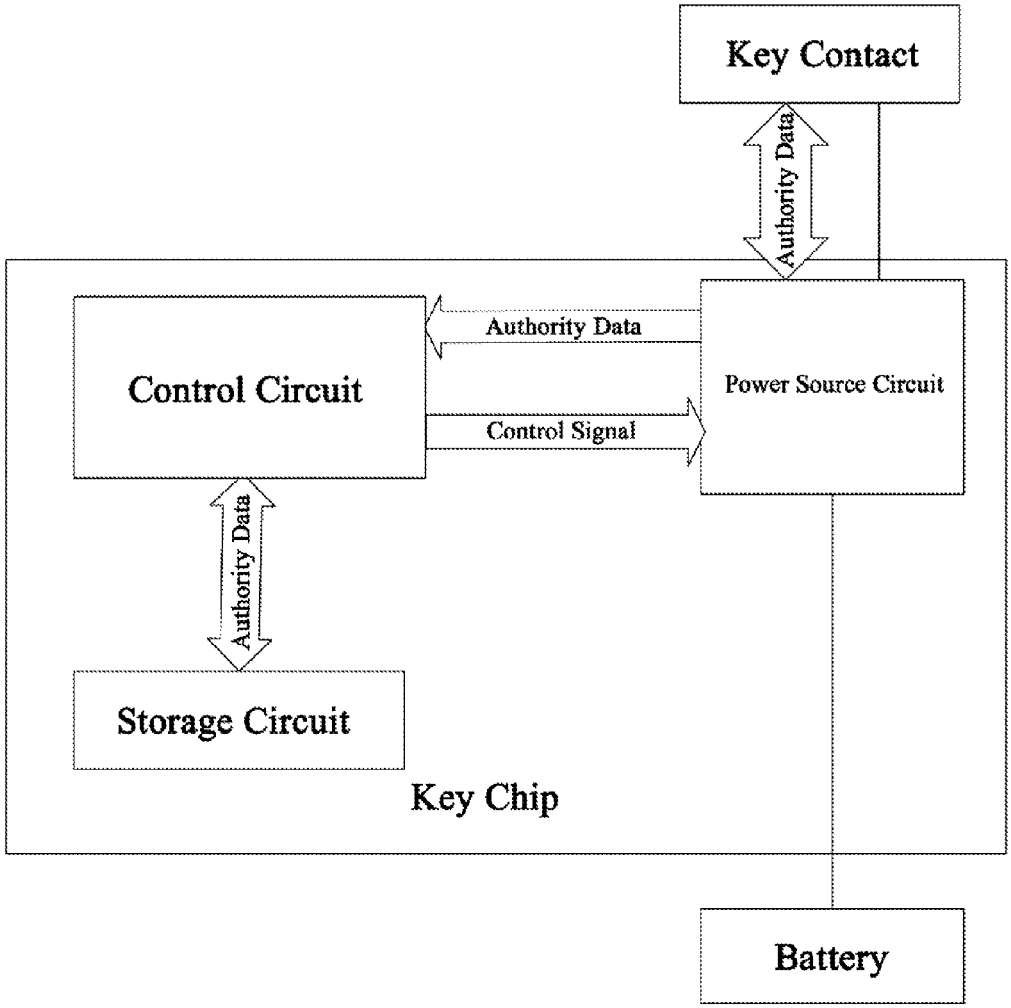
FIG. 17 is a block diagram of constituent of the internal circuit of the electronic key shown in FIG. 14.
Figure 18:
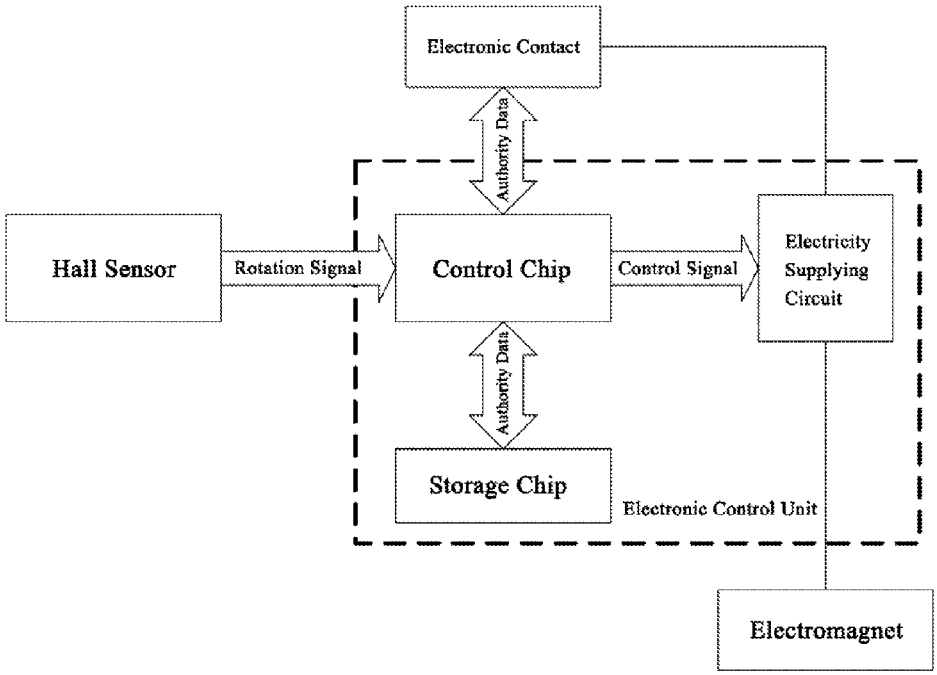
FIG. 18 is a block diagram of constituent of the internal circuit of the electronic lock cylinder according to an embodiment of the present invention.
Figure 22:
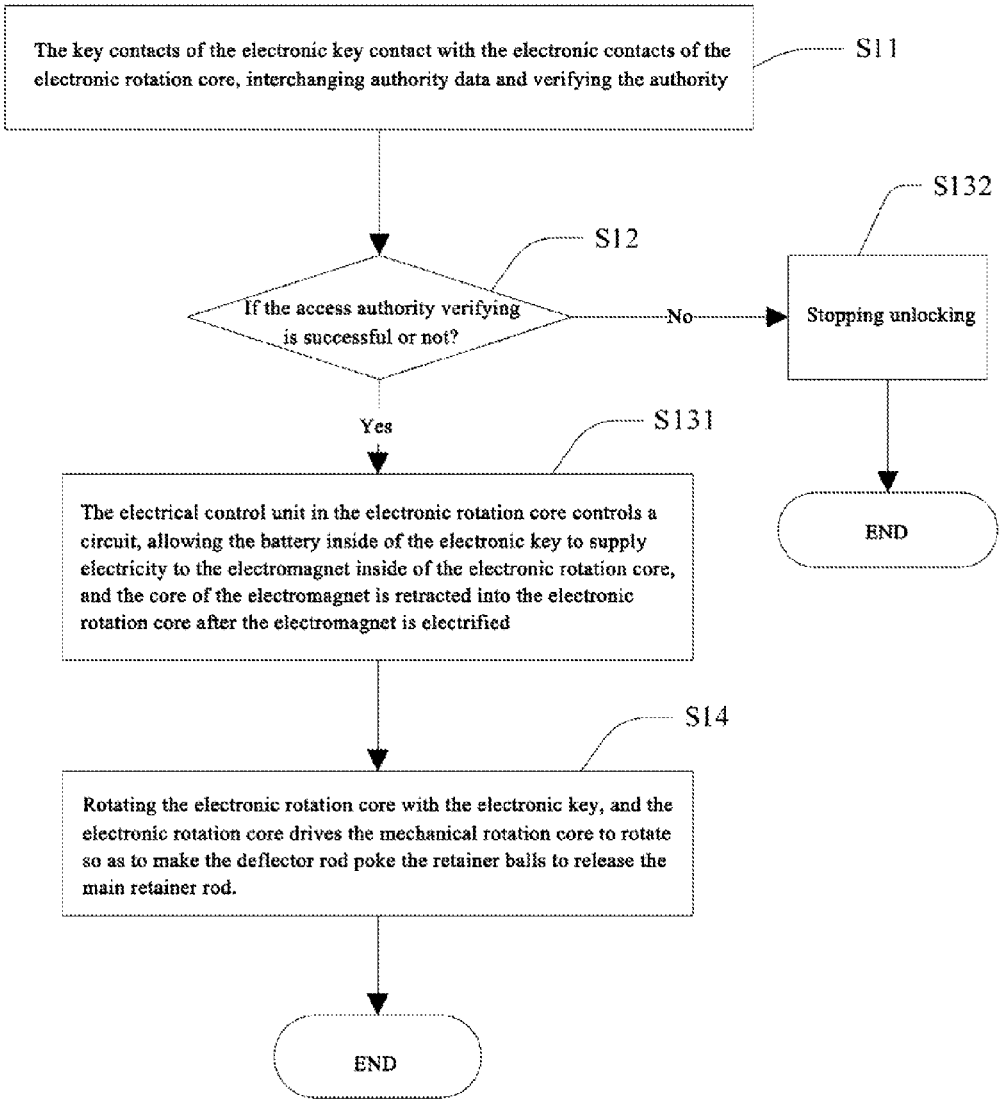
FIG. 22 is a diagrammatic flow chart of the unlocking method according to one embodiment of the present invention.

The unlocking method of the electronic lock system of the present invention is described with reference to the flow chart shown in FIG. 22 and the circuit structure diagram of the electronic key and the electronic rotation core shown in FIG. 17 and FIG. 18. To be noted that, FIG. 17 and FIG. 18 only illustratively indicate the signal flow and electric power transmission relation of the electronic key and the electronic rotation core. In FIG. 17 and FIG. 18, the signal flow is indicated by the large hollow arrow, and the electric power transmission is indicated by the narrow solid line.

The unlocking method for an electronic lock system of the present invention includes the following steps sequentially executed:

S11: The key contacts of the electronic key contact with the electronic contacts of the electronic rotation core, interchanging authority data and verifying the authority; and the determination can be made by a control chip inside the electronic rotation core or by the control circuit inside the electronic key. The authority data can be transferred from the electronic key to the electronic rotation core or transferred from the electronic rotation core to the electronic key, so long as to complement the authority verification.

S12: Determining if the access authority verification is successful or not, and if yes, proceeding to step S131, if no, proceeding to step S132; and comparing by the control circuit in the key chips of the electronic key based on the authority data stored in the storage circuit of the key chips or by the control chip of the electronic control unit of the electronic rotation core based on the authority data stored in the storage chips of the electronic control unit.

S131: The electronic control unit in the electronic rotation core controls the circuit, allowing the battery in the electronic key to supply electricity to the electromagnet inside the electronic rotation core, and the core of the electromagnet is retracted into the electronic rotation core after the electromagnet is electrified, and proceed to step S14;

S132: Stopping unlocking;

S14: Rotating the electronic rotation core with the electronic key, and the electronic rotation core drives the mechanical rotation core to rotate so as to make the deflector rod poke the retainer ball to release the main retainer rod, thus realizing unlocking.

As a preferable aspect, performing the following step while executing step S14:

after the electronic control unit in the electronic rotation core receives the rotation signal of the electronic rotation core detected by the Hall sensor, information on the person unlocking the lock will be recorded and stored. The above information can be stored in the storage chips of the electronic control unit or in the storage circuit of the key chips, or can be stored in both of the two above. Record of the unlocking activities can be more objective and accurate as the unlocking activities are recorded only after the electronic rotation core rotates.

As another preferable aspect, performing the following step while executing step S14: after the electronic control unit in the electronic rotation core receives the rotation signal of the electronic rotation core detected by the Hall sensor, the electronic control unit breaks the circuit of the electromagnet. That is, it is not necessary to supply electricity to the electromagnet after the electronic rotation core rotates, and then power source can be turn off, while further saving electric energy and increasing the usage life of the battery. And, after the electronic control unit in the electronic rotation core receives the rotation signal of the electronic rotation core detected by the Hall sensor, it can perform one of the following two tasks or both of the two tasks: (a) recording the information on the person unlocking the lock and storing the information; (b) breaking the circuit of the electromagnet. In this way, accuracy of the unlocking record is secured, making sure that only the actual unlocking will be recorded, and electricity can be saved.

Certainly, the above description is only the preferable embodiment of the present invention. Note that, for a person skilled in the art, many changes and modifications can be made without departing from the principle of the present invention, and these changes and modifications will fall into the protection scope of the present invention.

The invention claimed is:

1. An electronic lock cylinder, comprising a mechanical rotation core, an electronic rotation core, a housing having a barrel shape with both ends of the housing opened for accommodating the mechanical rotation core and the electronic rotation core, and a retainer rod; wherein one end of the housing is a front end, and a position limitation chuck for axial position limitation is located at an opening of the front end of the housing;

one end of the mechanical rotation core is a deflector rod with a flat portion, wherein the deflector rod is projected out of the front end of the housing, and a rear end of the mechanical rotation core is a first cavity of cylindrical shape, wherein at a position outside of a circle center of a bottom portion of the first cavity, there is a concave or recessed portion; a segment of a wall of the first cavity protrudes in an axial direction of the first cavity, forming a cambered position limitation portion, wherein a mechanical rotation core retainer slot, which is a through slot and in parallel with an axis of the first cavity, is provided at a middle portion of the cambered position limitation portion, dividing the cambered position limitation portion into a first position limitation portion and a second position limitation portion;

the electronic rotation core is of a multiple-segment cylindrical shape, wherein one end of the electronic rotation core is a rear end, and at the rear end of the electronic rotation core there are electronic contacts, a front end of the electronic rotation core is inserted into the first cavity so as to be rotationally connected with the mechanical rotation core, and an electronic control unit and an electromagnet are disposed in the electronic rotation core, wherein the electronic control unit is connected with the electronic contacts and the electromagnet, respectively, and controls an action of the electromagnet; a through hole for telescoping of a core of the electromagnet is located at a position where the front end of the electronic rotation core mates with the concave or recessed portion, and a spring is located inside the electronic rotation core such that the core abuts against the spring so as to be projected;

a cambered side slot is located at the front end of the electronic rotation core in a circumferential direction and is used to mate with the cambered position limitation portion of the mechanical rotation core, wherein the cambered side slot mates with the cambered position limitation portion in an axial direction of the electronic rotation core and the cambered side slot comprises an electronic rotation core retainer slot in the axial direction of the electronic rotation core, the electronic rotation core retainer slot dividing the cambered side slot into a first side slot corresponding to the first position limitation portion and a second side slot corresponding to the second position limitation portion, wherein an arc length of the first side slot is larger than or equal to an arc length of the first position limitation portion, and an arc length of the second side slot is larger than or equal to the sum of an arc length of the second position limitation portion and a width of the mechanical rotation core retainer slot; and an inner wall of the housing comprises a housing retainer slot in an axial direction of the housing.

2. The electronic lock cylinder of claim 1, wherein the electronic rotation core comprises a Hall sensor located at a position outside of a circle center of the front end surface of the electronic rotation core, and wherein the bottom portion of the first cavity of the mechanical rotation core comprises a magnet located at a position corresponding to the position of the Hall sensor.

3. The electronic lock cylinder of claim 1, wherein the opening of the front end of the housing comprises a triangular retainer block to limit a rotation angle of the deflector rod.

4. The electronic lock cylinder of claim 2, further comprising an end sealing and a platen with a circular shape, wherein a front end of the end sealing comprises a sliding recess with a circular shape, the end sealing is located at a rear end of the housing, and the end sealing is fixedly connected to the housing; and the platen is fixedly connected to the rear end of the electronic rotation core and the platen is located within the sliding recess.

5. The electronic lock cylinder of claim 1, wherein a wall of the electronic rotation core retainer slot and/or a wall of the housing retainer slot comprise slope(s).

6. The electronic lock cylinder of claim 1, wherein the arc length of the first position limitation portion is equal to the arc length of the second position limitation portion.

7. An electronic lock system comprising the electronic lock cylinder of claim 2, an electronic key, a lock body, and a main retainer rod having a "U" shape; wherein the electronic key includes a key rod and a key housing;

a middle upper portion of the key rod comprises a rotation guide channel in a circumferential direction of the key rod and an outer wall of a top portion of the key rod comprises a guide channel in an axial direction of the key rod which intersects the rotation guide channel;

an insertion end of the key rod comprises key contacts; the key housing comprises key chips, which are connected to the key contacts via wires, and a battery to supply electricity to the key chips;

an inner side of the U-shaped main retainer rod comprises an inclined recess;

the lock body comprises a lock cylinder mounting hole and two main retainer rod holes, wherein there is a through hole between an inner wall of the lock cylinder mounting hole and the two main retainer rod holes and the through hole is compatible with the inclined recess where the deflector rod of the electronic lock cylinder is located; inside the through hole there are retainer balls;

the electronic lock cylinder is located in the lock cylinder mounting hole of the lock body and the deflector rod of the electronic lock cylinder corresponds to positions of the retainer balls so as to poke the retainer balls to clamp or release the U-shaped main retainer rod.

8. A method for unlocking an electronic lock system, the method comprising the following steps sequentially executed:

A: contacting key contacts of an electronic key with electronic contacts of an electronic rotation core, interchanging authority data, and verifying authority;

B: determining if an access authority verification is successful, and, if yes, proceeding to step C1, and, if no, proceeding to step C2;

C1: supplying electricity with a battery located inside the electronic key to an electromagnet inside the electronic rotation core, retracting a core of the electromagnet into the electronic rotation core after the electromagnet is electrified, and proceeding to step D;

C2: stopping unlocking;

D: rotating the electronic rotation core with the electronic key and driving the electronic rotation core to rotate a mechanical rotation core, thereby causing a deflector rod to poke retainer balls, thereby releasing a main retainer rod.

9. The method of claim 8, further comprising performing the following step while executing step D:

after an electronic control unit in the electronic rotation core receives a rotation signal of the electronic rotation core detected by a Hall sensor, recording identifying information on a person unlocking the lock and storing the identifying information.

10. The method of claim 8, further comprising performing the following step while executing step D:

after an electronic control unit in the electronic rotation core receives a rotation signal of the electronic rotation core detected by a Hall sensor, causing the electronic control unit to break a circuit of the electromagnet.

* * * * *